US005628670A

United States Patent [19]

Hill

[11] Patent Number: 5,628,670

[45] Date of Patent: May 13, 1997

[54] TOY CONSISTING OF INTERCONNECTED HINGED BLOCKS

[76] Inventor: Allan F. Hill, 117 Brulo Trail, Kettleby, Ontario, Canada, L0G 1J0

[21] Appl. No.: 531,592

[22] Filed: Sep. 21, 1995

[51] Int. Cl.[6] ..... A63H 33/00

[52] U.S. Cl. ..... 446/487

[58] Field of Search ..... 446/487, 491, 446/489

[56] References Cited

U.S. PATENT DOCUMENTS

| | | | |
|---|---|---|---|
| 2,245,875 | 6/1941 | Rutherford | 446/487 |
| 2,809,467 | 10/1957 | Pierre et al. | 446/487 |
| 3,530,614 | 9/1970 | Strongin | 446/487 |
| 4,095,366 | 6/1978 | Buck et al. | 446/487 |
| 4,183,166 | 1/1980 | Borner | 445/487 |
| 4,657,248 | 4/1987 | Benaim | 446/487 |

FOREIGN PATENT DOCUMENTS

| | | | |
|---|---|---|---|
| 2261793 | 9/1975 | France | 446/487 |

*Primary Examiner*—Robert A. Hafer
*Assistant Examiner*—Jeffrey D. Carlson
*Attorney, Agent, or Firm*—K. Maxwell Hill

[57] ABSTRACT

A set of substantially square blocks which are hingedly interconnected in a linear series by ribbons which are fixed at both ends each block to both ends each adjacent block wherein each block consists two mating plates various colors made a dimensionally stable material which are fixed together holding the ribbons taut and fixed between them.

1 Claim, 5 Drawing Sheets

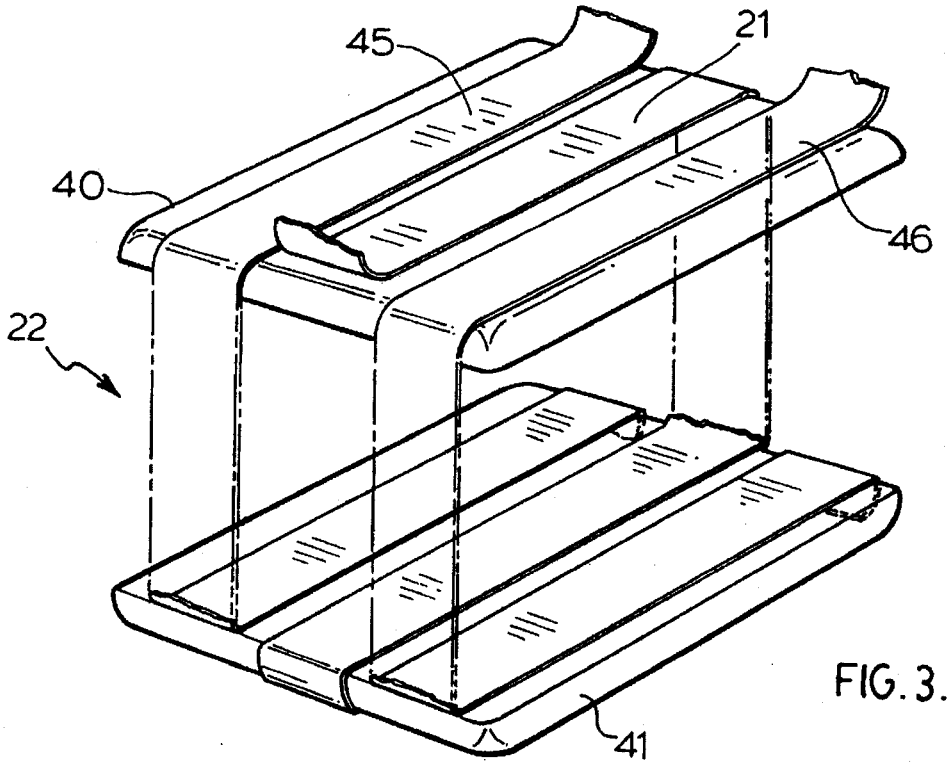
FIG. 3.
FIG. 2.
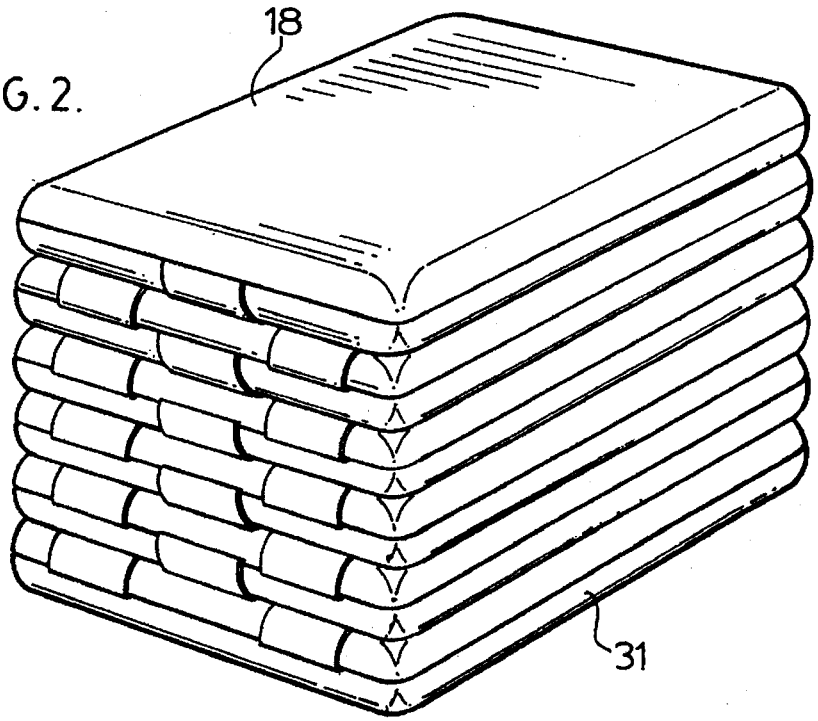

TOY CONSISTING OF INTERCONNECTED HINGED BLOCKS

BACKGROUND OF THE INVENTION

1. Field of the Invention

The present invention relates to both the improved construction and new action features of a toy known in Asia as a 'magic waterfall' and in America as 'jacobs ladder'. Millions of these toys were sold in North America in the early 1900's. However, it has not been commercially manufactured for approximately 60 to 70 years. Interestingly enough, all of the prior art toys were made exactly the same way. (See FIG. 1.) The toy consists of a series of flat blocks laid end to end and each block held to an adjacent block by at least three ribbons to provide a double hinge for adjacent blocks. Two of the ribbons are fixed to the end of one of the adjacent blocks and one of the ribbons is fixed to the other end of the same adjacent block. Each ribbon is free to fit across the face of the block to which it is fixed and then to be fixed to the adjacent block at the hinge point of the blocks. A double hinge is thereby made one with one ribbon in the one direction and the other with the pair ribbons in the opposite direction.

2. Background Information

It is known that the toy described above, being the prior art, is labour intensive and time consuming to manufacture as each ribbon or tape must be individually fixed to a block by hand. Specifically, fifteen ribbons had to be correctly measured, cut, positioned, glued, and kept the correct tension. Additionally, each ribbon or tape can fray and pull off the face of the block in question.

It is important to note also that the prior art allows the blocks to pivot in both directions and yet the toy can only take advantage of one directional pivoting. The following description will make this fact abundantly clear.

If one picks up the prior art by the top block held between the first finger and thumb while letting the other blocks hang downwards, making sure that the side of the block with the three glued ribbons faces out from the palm of your hand. Now tip the block in your hand forwards and down and you will note that no waterfall effect occurs even though the block did pivot. The face of the block with the three glued ribbons must be held towards the palm of your hand to make the prior art work as intended. This aspect of the prior art will be referred to in the new invention. (See SUMMARY)

It is also known that a portion of the 'magic' effect of the toy is seen to be the changing color effect of the flipping blocks where each block face has been colored with contrasting shades. The 'clacking' sound of the cascading of the hinged blocks is much of the surprise or magic effect of the blocks and thin wood was known to be the best material to give the required sound.

A means of manufacturing the toy that is less labour intensive, less time consuming, eliminates the fraying and pulling off of the ribbons, can produce at least two colors on each block, and requires a material that has the characteristics of thin wood without the need to shape each component by hand is needed.

SUMMARY OF THE INVENTION

Objects of the Invention

It is the principal object of the present invention to provide a 'jacobs ladder' type toy with additional features wherein the ribbons or tapes are held between opposite sides or faces of a split block, hereafter referred to as 'sandwich', with only the hinging portion of each ribbon free but taut across the face of the blocks, It is a further object of the invention to make each face of a particular block of a different color to make the interaction of the blocks one with another more spectacular.

It is a further object of the invention to make the blocks from a dimensionally stable material such as wood, wood based products or plastic materials, that will provide the required clacking sound to the flipping blocks as they strike one another as movement is initiated.

Summary

A plurality of substantially square blocks are held together in a linear series by tapes or ribbons wherein each end block is fixed at both ends to both ends of the adjacent interior block and all interior blocks are fixed at both ends to both ends of the two adjacent blocks in the series. Each block is made from a rigid material such as wood or plastic and consists of two planar halves, hereafter referred to as 'plates', that mate with one another, plate-surface to plate-surface. The ribbon or tape is fixed to the plates by being placed between the halves of the blocks prior to the block halves being fastened together. The ribbon or tape can be glued, stapled, pierced or otherwise fixed between the two halves of the block interior sides. Glue, staples pins or the like can then be used to hold each of the halves together. Greater control over the manufacture of the toy can be achieved by using the split block and the portion of each ribbon or tape that falls across the face of an adjacent block can be kept taut during the manufacture to ensure proper tension in each tape and thereby neat uniform hinging action when the toy is in use.

A major change resulting from this previously referred to sandwich effect is that the number of individual ribbons is reduced from 15 small pieces in the case of the prior art (assumes a six block toy), to just 3 continuous ribbons in the new invention. Additionally the fixation points, which have been reduced from 30 in the case of the prior art to 18 in the new invention, now lie between the mating halves which prevents ribbons from fraying or being pulled off the face of a block. It is estimated that the prior art takes roughly 10 hours to make when you consider wood preparation, assembly and glue drying time. However, it takes only 2½ hours to make the new invention using wood and glue. With plastic parts, assembly time for the new invention would be measured in minutes. This assembly time reduction is a tremendous manufacturing benefit. Sandwiching the ribbons between the plates has eliminated all of the prior arts disadvantages.

Small children, whose wrist dexterity is not fully developed have found they can use the toy in other play modes such as by holding the toy horizontal and while holding each of the end blocks in the series can make the internal blocks jump up and down and make different actions.

It is when the toy is used in this manner that various other movements and shapes or patterns can be created, of which several of these are exclusive to the new invention. As mentioned in, BACKGROUND INFORMATION, the prior art pivots in both directions, yet only takes advantage of one directional pivoting. However the new invention by its design is limited to one directional pivoting, thereby being able to use the non pivoting position to create new action features. None of these new movements can be duplicated with the prior art. However all movements of the prior art can be duplicated with the new invention. These new movements are as unique as the prior arts waterfall effect.

With regard to the block surfaces themselves the prior art used these surfaces to fix the ribbons to. However, the new invention frees up these surfaces completely. Therefore they can be used for decals, imprints, hot foil stamping, etc. For example, a set of blocks with cartoon characters on each block. The prior art block surfaces also had to be substantially smooth, to be able to glue on the ribbons. However, the new invention allows irregular surfaced blocks which could incorporate various surface designs, for example a company logo.

From a marketing point of view this freeing up of the block surfaces has tremendous value.

Additionally, manufacturing the blocks with rounded edges allows for a more graceful interaction at the hinge points. This makes the inventions movements more magical because one movement flows right into another.

BRIEF DESCRIPTION OF THE DRAWINGS

With the foregoing objects in view and such other advantages or novel features as may become apparent from consideration of this disclosure and specification the present invention consists of the concept which is comprised, embodied and embraced and included in the use, construction and arrangement of parts or any use of the same herein exemplified in the specific embodiment of the concept; reference being had to the accompanying drawings wherein like reference numerals refer to like parts.

FIG. 2. is the present invention showing in perspective the blocks hinged together and at rest prior to lifting for play.

FIG. 3. is a perspective exploded view of the present invention showing how one half of the block is fitted to the other half with ribbons fixed between by glue, staples or the like.

DETAILED DESCRIPTION AND OPERATION OF THE INVENTION AND PREFERRED EMBODIMENT THEREOF

Figure 1:
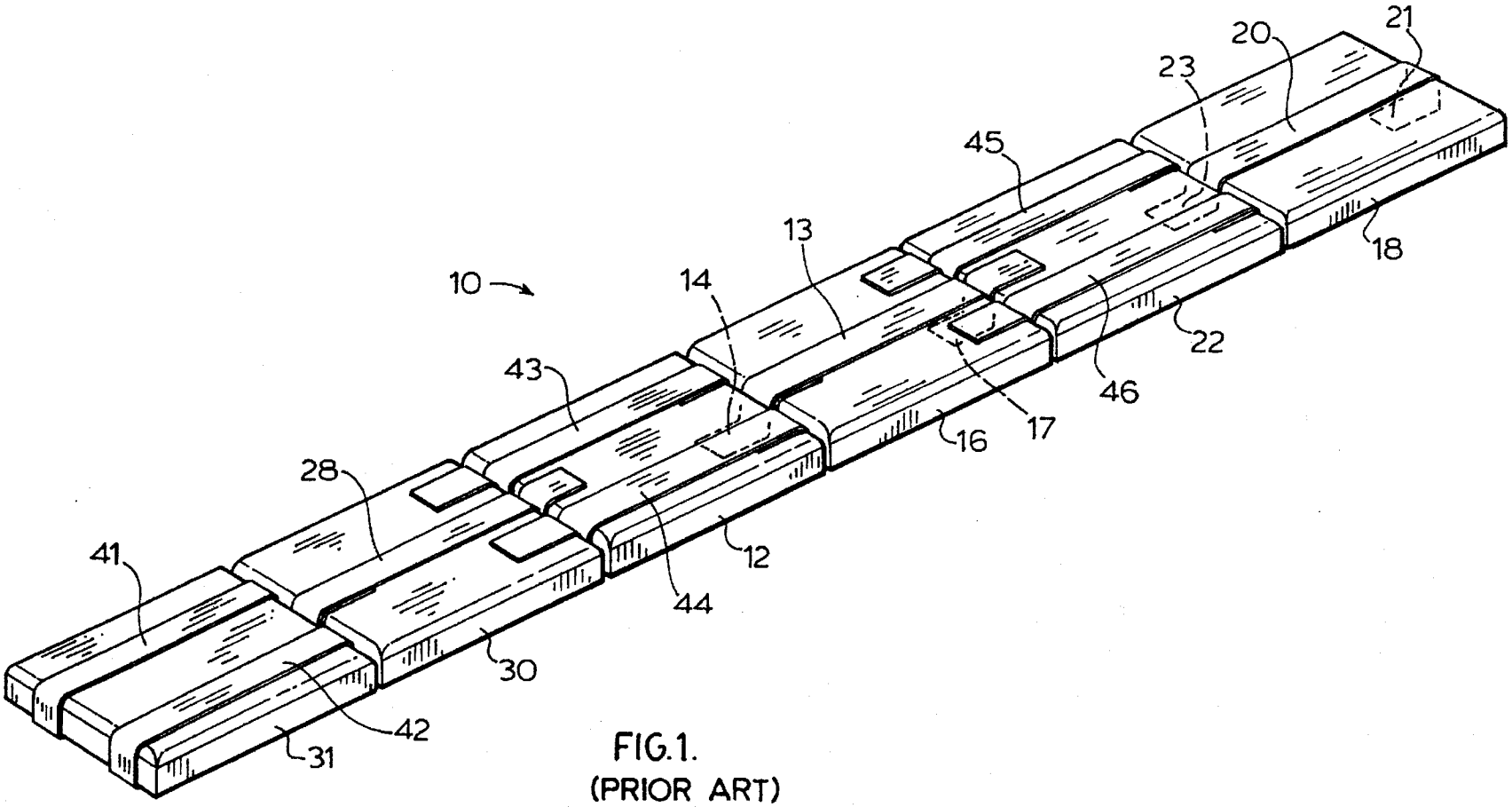
FIG.1. (PRIOR ART)
FIG. 1. is a perspective view of a six block example of a prior art toy showing how the ribbons are attached.

In FIG. 1. numeral 10 represents the toy of the prior art and shows the ribbons attached to the blocks. One block is enumerated 12 and one ribbon 13. Ribbon 13 is fixed to the bottom of block 16 at 17 and to the bottom of block 12 at 14. Similarly block 18 has a single ribbon 20 fixed substantially at the top (underside) at 21 and then runs freely but with tension to block 22 and is fixed to the bottom at 23 to block 22 by glue. It is understood that ribbon 20 as with ribbon 13 and 28 are each separate ribbons that lie taut across the faces of blocks 18, 16 and 30 respectively and are attached to the undersides of each of their blocks and to the underside of one adjacent block i.e. 22, 12 and 31. Each of these single ribbons makes a hinge between adjacent blocks. Double ribbons 41–42, 43–44, and 45–46 are fitted across the faces of blocks 31, 12 and 22 and are fixed to the undersides of those blocks and to the undersides of the adjacent blocks 30, 16 and 18 respectively.

In FIG. 2. the present invention is shown in stacked position with the mated plates 18 through 31, fitted one above the other and the three ribbons or tapes, threading through and held by the mating halves.

In FIG. 3. the mating halves of a block 22 are exploded from one another to show how they 40, 41, mate with one another and maintain the ribbons 45, 46, 21, between them. When using wooden or wood based plates, glue, staples or other means can be employed to attach the ribbons to the plates and hold them together.

Figure 4:
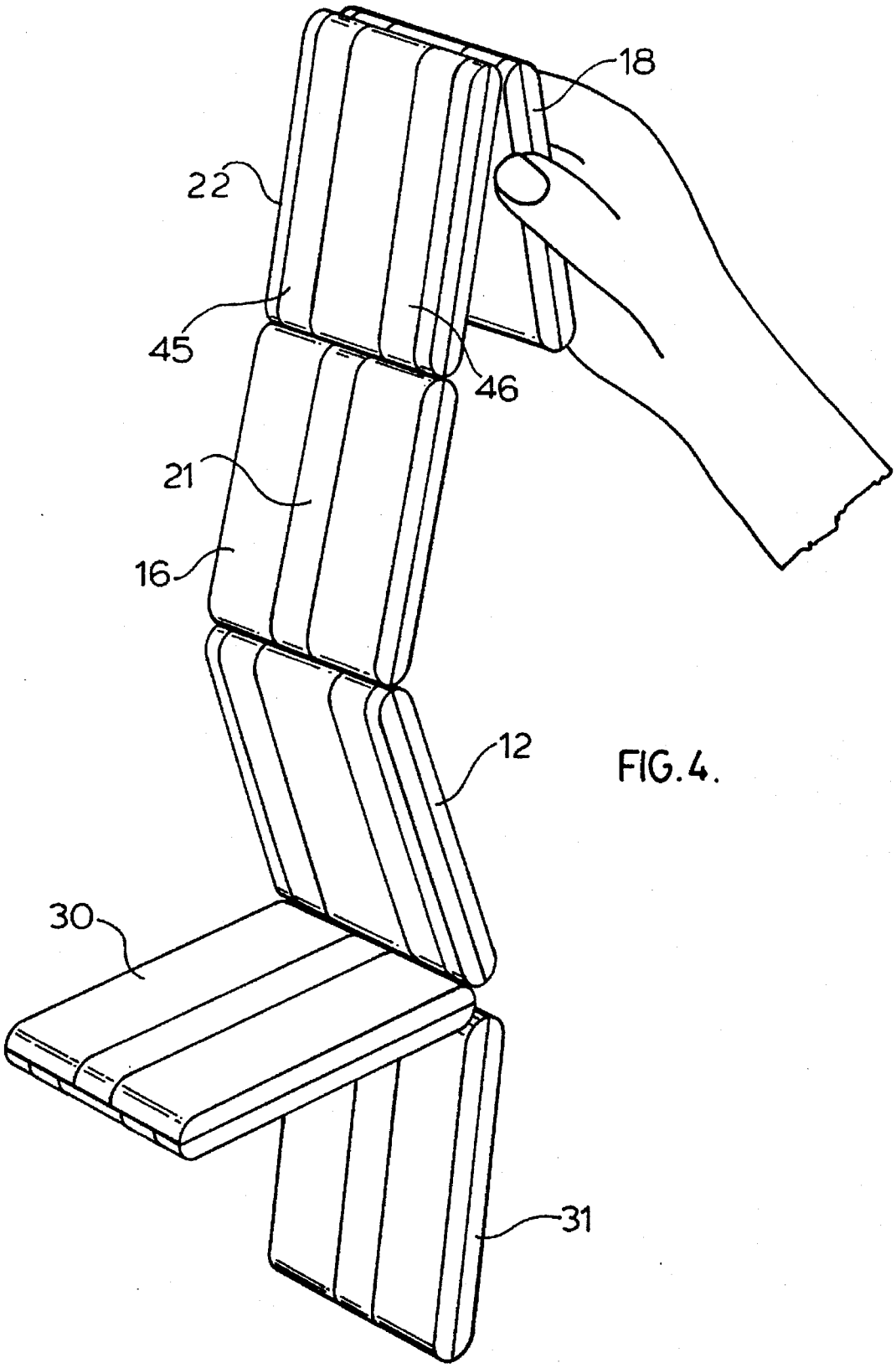
FIGS. 4–4C. shows how the toy is held upright by a hand with an enlarged view, of the top block causing to flip or hinge the next block over itself and thereby flipping each of the blocks in turn with the second last block flipping as the action reaches it.
Figure 4A:
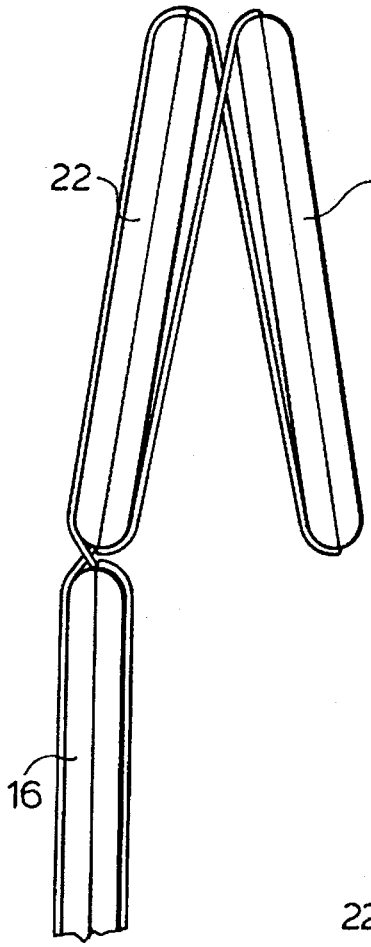
Figure 4B:
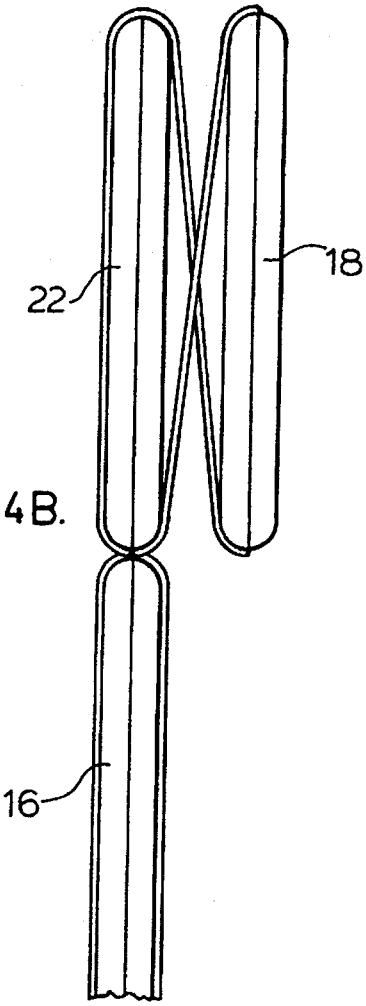
Figure 4C:
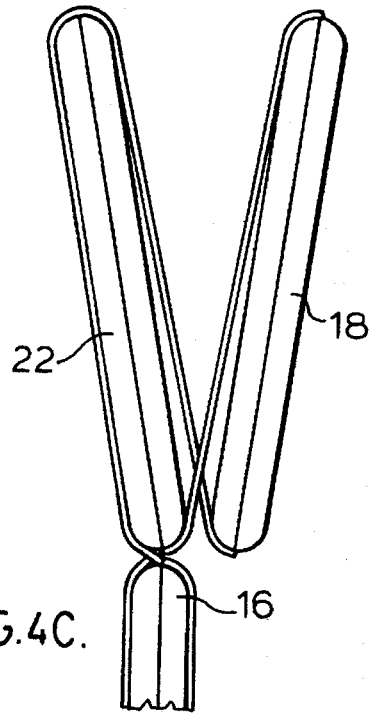

In FIG. 4. the upper block 18 is shown held by a hand by its edge and flipped downward thereby to initiate the repositioning of the hinge, (see FIG. 4A., 4B., 4C. ), created by ribbons 45, 46, 21, which in the position shown are about to 'hinge' allowing block 22 to pivot and flip downward. The cascading effect is thus created throughout the series of blocks as the action of the flip over and downward is followed sequentially by each block until the last one is reached and it flips over. By quickly flipping the uppermost block before the action reaches the last block a ripple effect can be achieved with more than one block flipping at one time.

Block 30 is about to pivot about its hinge with the lower block 31 and the lower edge of block 31 now becomes its upper edge. It will be seen that by the action of flipping downward block 18 each adjacent block will reverse its position by means of the ribbon hinge with the adjacent block. The upper and lower edges of adjacent blocks reversing positions creates the 'cascading' effect.

Figure 5:
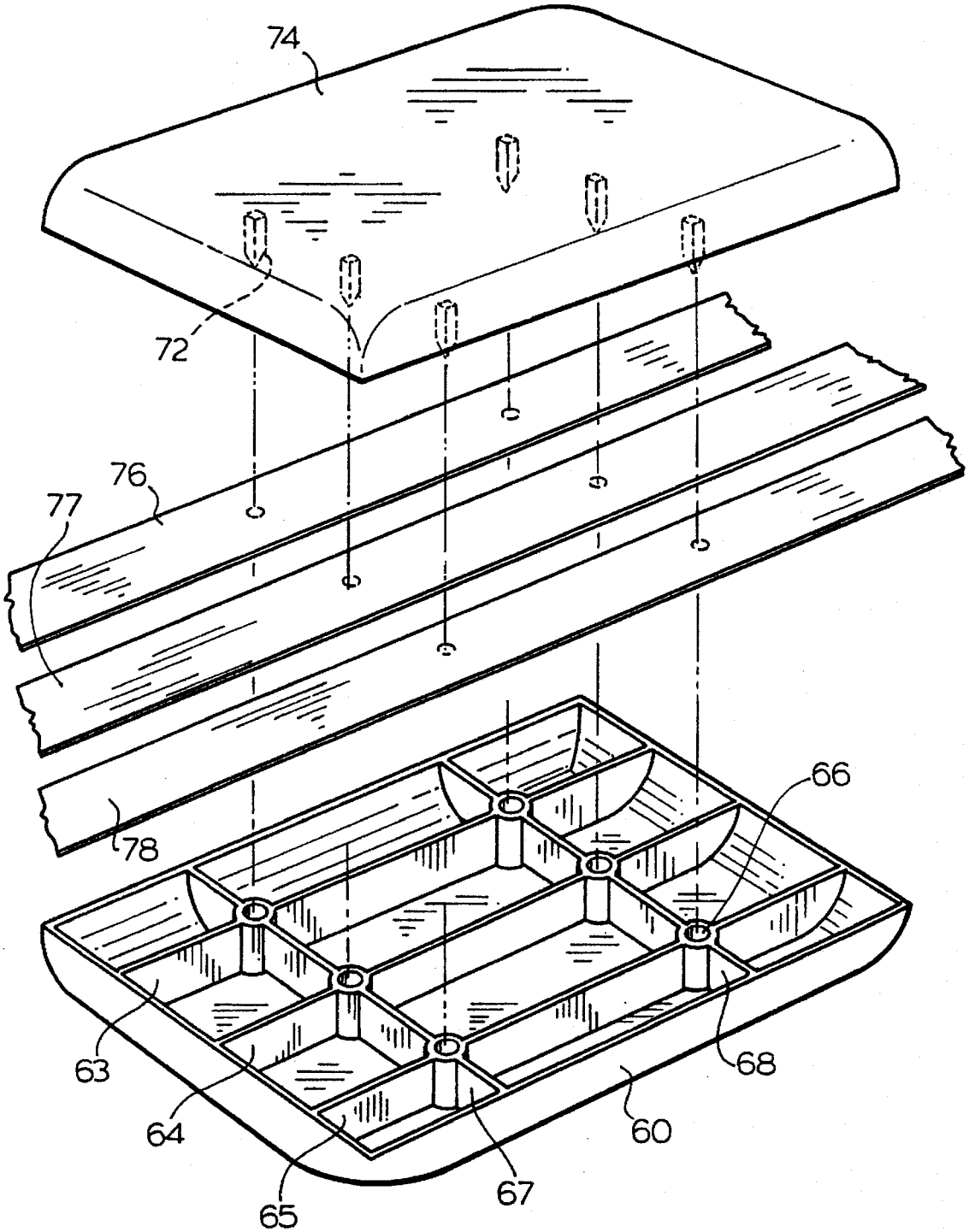
FIG. 5. is the preferred alternative construction of the invention in perspective with an exploded view of the two halves of the block showing how the two plates mate with the ribbons pierced and fixed between them An alternative construction of the invention, (not show), consists of substantially square hard plastic top and bottom plates which are made to snap together around their perimeters to hold the ribbons between them without the need of glue or other means of fixation. This means of snapping plastic parts together is well known in the plastics industry. Note, substantially square as represented in this specification is defined as any block wherein the hinged edges are relatively straight and parallel and the adjacent edges are any irregular shape whatsoever.

In FIG. 5. the preferred embodiment of the invention is shown wherein a pair of substantially square plates are shown exploded from one another and when together they comprise a block with the ribbons held between them. The plates are made of an injection molded dimensionally stable plastic having a high gloss and of a bright color as is used for toys in the art. The female half of the block, enumerated 60, has ribs 67, 68, running one way, and ribs 63, 64, 65, crossing them with sockets 66 formed at each crossing of ribs. Note, plate 74 has correspondingly matching ribs (not shown). The sockets are rounded slots into which the pins, enumerated 72, of the male plate 74 are seated thereby holding the female plate 60 and the male plate 74 together. The ribbons 76, 77, 78, that overlie the ribs are pierced by the pins 72 and held firmly in the interior of the block, by both the ribs and the pins.

What I claim is:

1. A Jacob's Ladder type toy comprising in combination; a set of substantially square blocks hingedly interconnected in a linear series by three ribbons fixed at both ends of each said substantially square blocks to both ends of each adjacent said substantially square blocks running from the ends of said substantially square blocks over the surfaces of said substantially square blocks to the ends of each adjacent said substantially square blocks wherein each of said substantially square blocks consists of two mating plates made of a dimensionally stable plastic, one half of said mating plates having a first hollow cavity with first ribs with round sockets formed at each crossing of said first ribs and the other half of said mating plates having a second hollow cavity with second ribs lining up and matching said first ribs with square pointed pins formed at each crossing of said second ribs, which when said mating plates are fixed together said square pointed pins pierce said ribbons, where each said ribbons consist of one continuous piece running from the first of said substantially square blocks in said series to the last of said substantially square blocks in said series and each of which passes between said mating plates of each said substantially square blocks, and said square pointed pins are seated in said round sockets thereby holding said mating plates together while holding said ribbons firmly in the interior of said substantially square blocks by both said first ribs and said second ribs and said square pointed pins.

* * * * *